US007578027B2

(12) United States Patent
Kim

(10) Patent No.: US 7,578,027 B2
(45) Date of Patent: Aug. 25, 2009

(54) APPARATUS OF MOUNTING DUST COLLECTION UNIT FOR VACUUM CLEANER

(75) Inventor: Kyung Chul Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 560 days.

(21) Appl. No.: 11/297,342

(22) Filed: Dec. 9, 2005

(65) Prior Publication Data

US 2006/0123589 A1 Jun. 15, 2006

(30) Foreign Application Priority Data

Dec. 13, 2004 (KR) ..... 10-2004-0105169

(51) Int. Cl.
*A47L 9/10* (2006.01)
*A47L 9/16* (2006.01)

(52) U.S. Cl. ..... 15/352; 15/327.1

(58) Field of Classification Search ..... 15/352, 15/353, 327.1, 327.2, 327.6
See application file for complete search history.

(56) References Cited

U.S. PATENT DOCUMENTS 5,935,280 A 8/1999 Lee et al.
6,317,921 B1 11/2001 Park et al.
6,735,816 B2 * 5/2004 Oh et al. ..... 15/353
6,782,584 B2 * 8/2004 Choi ..... 15/352
6,922,868 B1 * 8/2005 Jeong ..... 15/353
7,191,490 B2 * 3/2007 Lee et al. ..... 15/352
2002/0166310 A1 11/2002 Bilek et al.
2004/0123416 A1 7/2004 Lee

FOREIGN PATENT DOCUMENTS

| | | | |
|---|---|---|---|
| DE | 102 48 087 | A1 | 4/2004 |
| EP | 0 837 535 | A2 | 4/1998 |
| EP | 1 214 903 | A2 | 6/2002 |
| GB | 386975 | | 1/1933 |
| GB | 2 097 284 | A | 11/1982 |
| GB | 2 380 956 | A | 4/2003 |
| WO | WO-2004/034866 | A1 | 4/2004 |

* cited by examiner

*Primary Examiner*—David B Thomas
(74) *Attorney, Agent, or Firm*—Birch, Stewart, Kolasch & Birch, LLP

(57) ABSTRACT

A vacuum cleaner includes a main body, a dust collection unit for filtering foreign objects contained in air introduced from the main body, a mounting portion provided on the main body to mount the dust collection unit, an elastic press unit provided under or above the dust collection unit to bias the dust collection unit, and a hook unit biased by the elastic press unit and provided between the dust collection unit and the mounting portion.

17 Claims, 7 Drawing Sheets

APPARATUS OF MOUNTING DUST COLLECTION UNIT FOR VACUUM CLEANER

BACKGROUND OF THE INVENTION

1. Field of the Invention

The present invention relates to a vacuum cleaner, and particularly, to an apparatus of easily mounting and separating a dust collection unit in or from a main body of a vacuum cleaner.

2. Description of the Related Art

A typical vacuum cleaner includes a suction nozzle unit sucking air containing foreign object while moving along a floor, a main body with a unit for generating air suctioning force through the suction nozzle unit, a dust collection unit for filtering foreign object contained in the air sucked into the main body, and an operating unit mounted on the main body so that a user grasps the operating unit in use.

The dust collection unit functions to collect foreign objects contained in the sucked air. After the foreign objects are collected in the dust collection unit, the dust collection unit is separated from the main body so that the user can draw away the collected foreign objects.

When the vacuum cleaner is operated, a variety of impacts may be applied to the vacuum cleaner. The impacts may cause the dust collection unit to be separated from a dust collection unit-mounting portion of the vacuum cleaner. To prevent this, at least one hook portion is provided between the dust collection unit and the dust collection unit-mounting portion.

Therefore, in order for the user to separate the dust collection unit from the mounting portion, the user first releases the hook portion and pulls the dust collection unit outward. This is a troublesome for the user.

Furthermore, in order to operate the hook portion, a predetermined manipulation portion should be provided on an outer portion of the main body. This may deteriorate the outer appearance of the vacuum cleaner.

SUMMARY OF THE INVENTION

Accordingly, the present invention is directed to a vacuum cleaner, which substantially obviates one or more problems due to limitations and disadvantages of the related art.

An object of the present invention is to provide a vacuum cleaner that is designed to easily treat a dust collection unit.

Another object of the present invention is to provide a vacuum cleaner that can stably fix a dust collection unit without using any member that is provided on an outer portion of a main body of the vacuum cleaner to be used to fix the dust collection unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a vacuum cleaner including: a main body; a dust collection unit for filtering foreign objects contained in air introduced from the main body; a mounting portion provided on the main body to mount the dust collection unit; an elastic press unit provided under or above the dust collection unit to bias the dust collection unit; and a hook unit biased by the elastic press unit and provided between the dust collection unit and the mounting portion.

In another aspect of the present invention, there is provided a vacuum cleaner including: a main body; a dust collection unit for filtering foreign objects contained in air introduced from the main body; a mounting portion provided on the main body to mount the dust collection unit; an elastic press unit provided under the dust collection unit to bias the dust collection unit upward; and a hook unit provided between the dust collection unit and the mounting portion.

In still another aspect of the present invention, there is provided a vacuum cleaner including: a main body; a dust collection unit for filtering foreign objects contained in air introduced from the main body; a mounting portion provided on the main body to mount the dust collection unit; an elastic press unit for biasing the dust collection unit toward the mounting portion; and a hook biased by the elastic press unit and provided between the dust collection unit and the mounting portion to prevent the dust collection unit from being inadvertently separated from the main body.

According to the present invention, it is very convenient in mounting and separating the dust collection unit from the main body of the vacuum cleaner.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
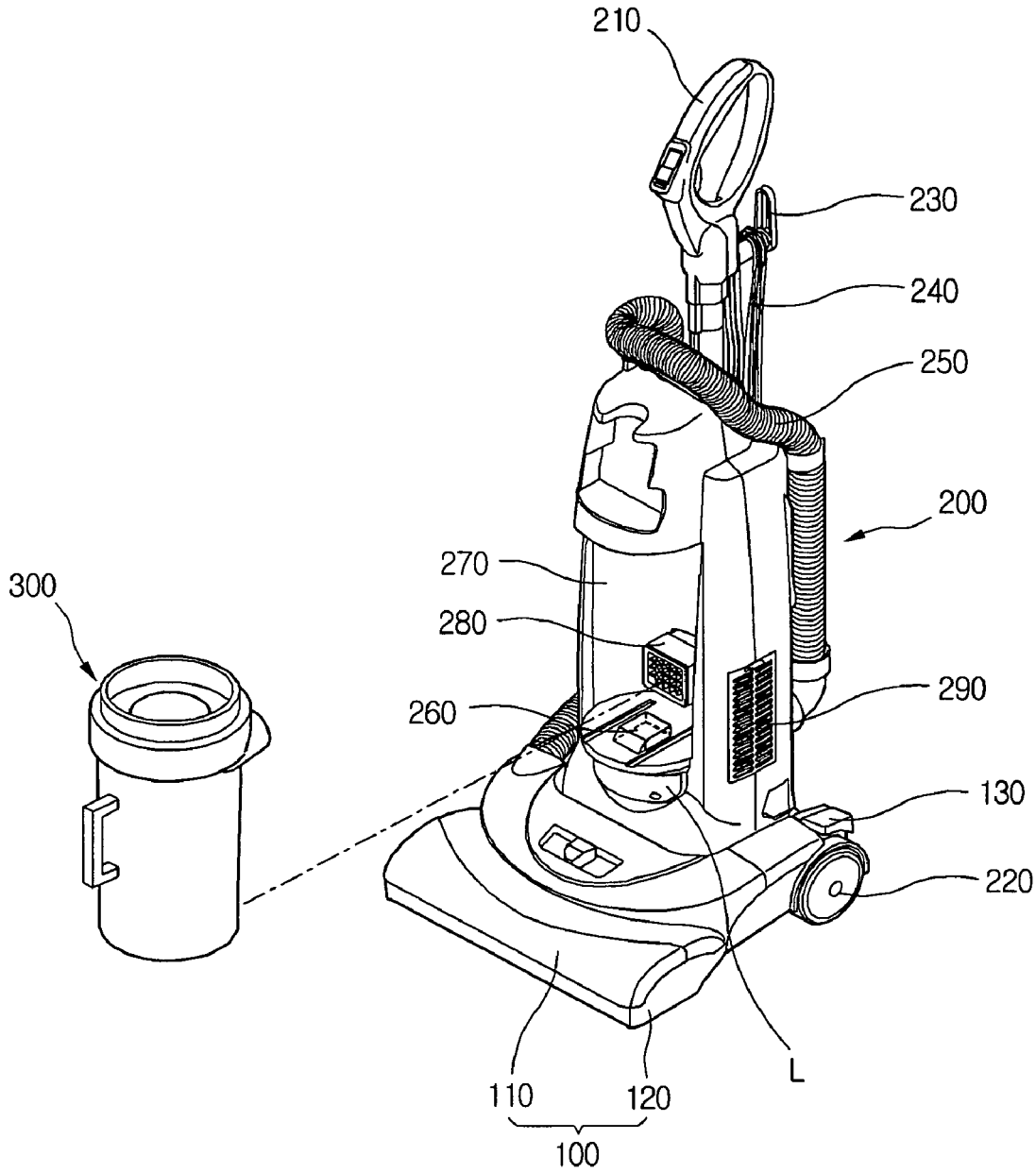
FIG. 1 is a perspective view of a vacuum cleaner according to an embodiment of the present invention.
Figure 2:
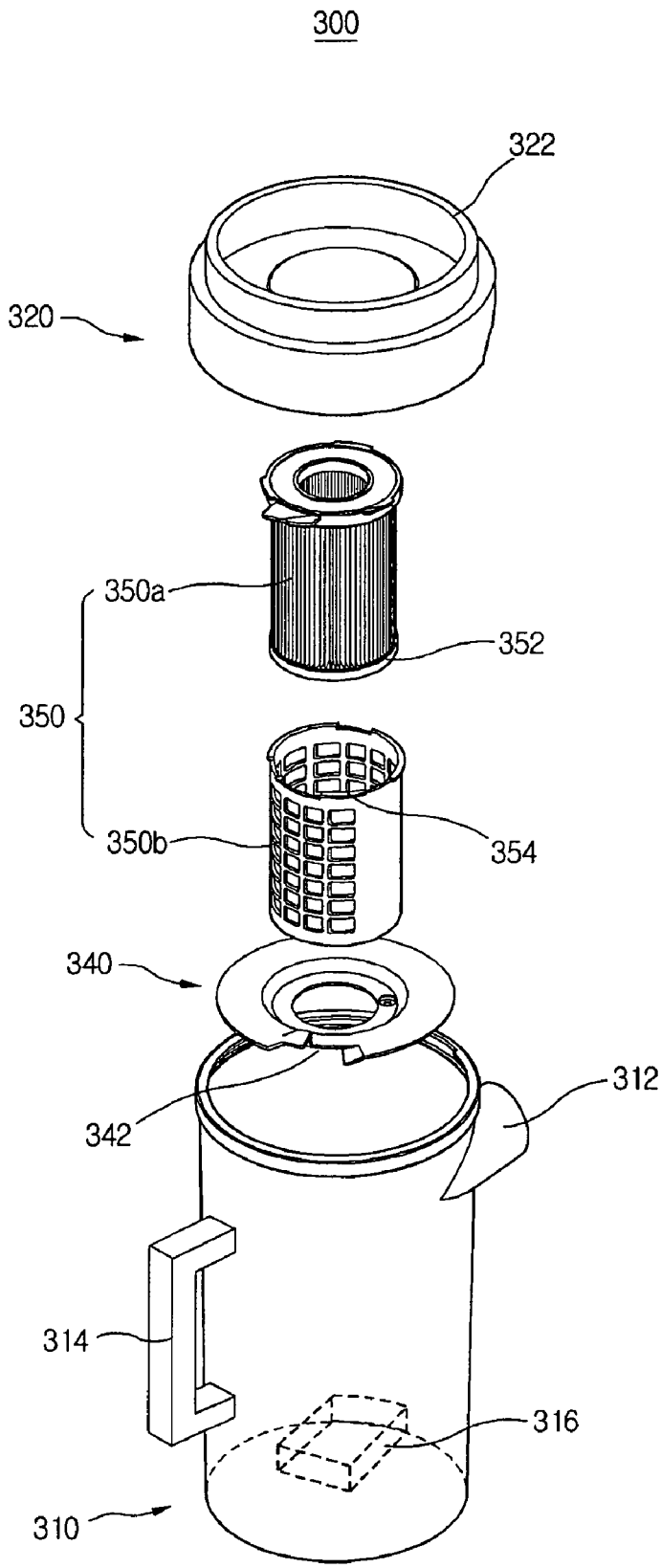
FIG. 2 is an exploded perspective view of a dust collection unit depicted in FIG. 12.
Figure 3:
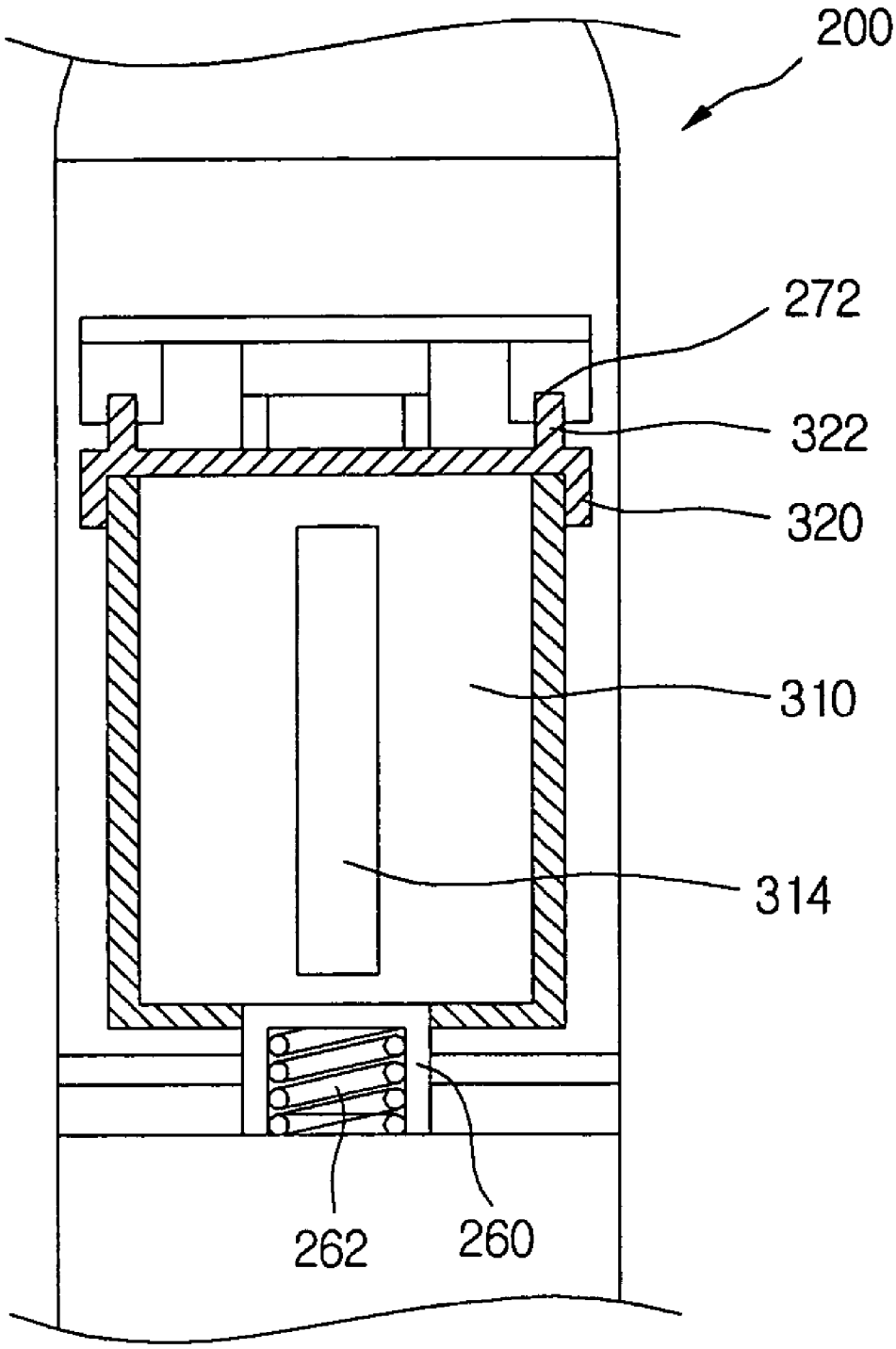
FIG. 3 is a schematic front view illustrating a state where a dust collection unit is inserted in a mounting portion of a vacuum cleaner according to the present invention.

FIG. 1 is a perspective view of a vacuum cleaner according to an embodiment of the present invention, FIG. 2 is an exploded perspective view of a dust collection unit depicted in FIG. 12, and FIG. 3 is a schematic front view illustrating a state where a dust collection unit is inserted in a mounting portion of a vacuum cleaner according to the present invention.

Referring to FIGS. 1 through 3, the upright type vacuum cleaner includes a suction nozzle unit 100 sucking air containing foreign object while moving along a floor, a main body 200 with a unit for generating air suctioning force through the suction nozzle unit 100, and an operating unit 210 mounted on the main body so that a user grasps the operating unit in use.

The suction nozzle unit 100 is designed to suck the air through an air intake (not shown) formed on a bottom of the suction nozzle unit 100. That is, the suction nozzle unit 100 includes a nozzle upper cover 110 and a nozzle lower cover 120. The nozzle lower cover 120 is provided with an air intake passage. Wheels 200 are provided on both side portions of the suction nozzle body 100.

The main body 200 is designed to pivot rearward within a predetermined angle range with respect to the suction nozzle body 100. To control the pivotal motion of the main body 200, a pivot lever 130 is provided on a top-rear end of the suction nozzle body 100. Therefore, when the user steps on the pivot lever 130 and pulls the main body 200 rearward using the operating unit 210, the main body 200 is inclined rearward. Therefore, the user can adjust an angle of the main body 200 in response to his/her height.

A pair of wire fixing members 230 are symmetrically formed on a rear portion of the main body 200. An electric wire for supplying electric power is wound around the wire fixing members 230.

A motor (not shown) for generating suctioning force is installed in the main body 200 to suck the air through the suction nozzle unit 100. A suction hose 250 is provided on a center portion of the main body 200 to guide the foreign objects contained in the air sucked through the suction nozzle unit 100 to a dust collection unit 300 that will be described later.

The main body 200 is provided with a mounting portion 270 that is pressed into the main body 200 to have a shape corresponding to an outer portion of the dust collection unit 300.

The mounting portion 270 is provided with a dust container seal 280 defining a passage through which the air is introduced. The dust container seal 300 surface-contacts the dust collection unit 300 to prevent the air from leaking between the dust collection unit 300 and the motor. The dust container seal 280 may be formed of elastic material.

A multi-joint supporting unit 260 is provided on a bottom of the mounting portion 270. The multi-joint supporting unit 260 is designed to vertically move when the dust collection unit 300 is mounted or separated on or from the mounting portion 270.

The multi-joint supporting unit 260 is composed of a plurality of flat plates that are hinge-coupled to one another so that it can flexibly move in response to the bottom of the dust collection unit 300 when mounting and separating the dust collection unit 300.

An elastic member 262 is provided under the multi-joint supporting unit 260 to bias the multi-joint supporting unit 260 upward. Therefore, when the interference between the multi-joint supporting unit 260 and the bottom of the dust collection unit 300 is released, the multi-joint supporting unit 260 is returned to its initial position by the elastic member 262. A front portion of the multi-joint supporting unit 260 is inclined at a predetermined angle to guide the insertion of the dust collection unit 300 by being smoothly bent.

The mounting portion 270 is provided at a top surface with a separation preventing groove 272. The separation preventing groove 272 is formed corresponding to a separation preventing rib 322 of the dust collection unit 300. The separation preventing groove 272 is formed in a circular frame shape.

A lamp L is installed on a front-lower portion of the main body 200. That lamp L can be effectively used when it is intended to clean a dark space.

A discharge portion 290 is provided on a right portion of the lamp L. The air passed through the dust collection unit 300 is discharged to an external side of the main body via the dust container seal 280. An exhaust filter (not shown) is provided in the discharge portion 290. That is, foreign objects contained in the air that is being exhausted to the external side is further filtered by the exhaust filter.

The dust collection unit 300 is separately mounted in the mounting portion 270 to function to filter foreign objects contained in the air introduced through the suction nozzle body 100. The dust collection unit 300 may employ a cyclone type collection unit, a filter type collection unit or a combination of the cyclone and filter type collection units.

The dust collection unit 300 includes a dust collection container 310 and a top cover 320 defining a top of the dust collection container 310. An air intake guide 312 is projected from an upper end of the dust collection container 310 to allow the air containing the foreign objects to be introduced into the dust collection container 310.

A handle 314 is provided on an outer circumference of the dust collection container 310. The user can discharge the foreign objects accumulated in the dust collection container 310 and can mount or separate the dust collection unit 300 with his/her hand grasping the handle 314.

A portion of the bottom of the dust collection unit is pressed inside to define a guide 316 having a width identical to that of the multi-joint supporting unit 260. The guide 316 guides the sliding motion of the multi-joint supporting unit 260 when the dust collection unit 300 is mounted in the mounting portion 270. When the dust collection unit 300 is mounted, the guide 316 is biased upward by the multi-joint supporting unit.

The separation preventing rib 322 is provided on an upper-outer circumference of the top cover 320. The separation preventing rib 322 corresponds to the separation preventing groove 272 so that it can be inserted in the separation preventing groove 272 when the dust collection unit 300 is mounted in the mounting portion 270, thereby preventing the dust collection unit from being inadvertently separated from the mounting portion 270.

A separation plate 340 for dividing the space of the dust collection unit 310 into upper and lower chambers is provided on a center of the dust collection unit 310 to collect relatively large foreign objects in the lower chamber. A dropping portion 342 is provided on an outer circumference of the separating plate 340. The upper and lower chambers communicate with each other through the dropping portion 342.

A filter assembly 350 is provided between the top cover 320 and the separation plate 340 to filter the foreign objects contained in the air introduced into the dust collection unit 300. The filter assembly 350 may be formed of a material having a predetermined strength so that it may not be deformed when it is washed.

The operation of the vacuum cleaner will be described below.

When the vacuum cleaner is turned on, the motor in the main body 200 generates suctioning force so that the suction nozzle unit 100 sucks the outer air containing foreign objects. The air is directed into the dust collection unit 310 through the air intake guide 312.

In the dust collection unit 310, the relatively large foreign objects contained in the air falls under the separating plate 340 through the dropping portion 342. The air containing the relatively small foreign objects is directed into the filter assembly 350.

While the air passes through the filter assembly 350, the relatively small foreign objects are filtered and accumulated in the dust collection unit 310.

The air that has passed through the filter assembly 350 is discharged out of the dust collection unit 300 through the discharge guide tube (not shown). Then, the air passes through the dust container seal 280 formed on the mounting portion 270 and discharged out of the vacuum cleaner through the discharge portion 290 mounted on an outer surface of the main body 200.

Figure 4:
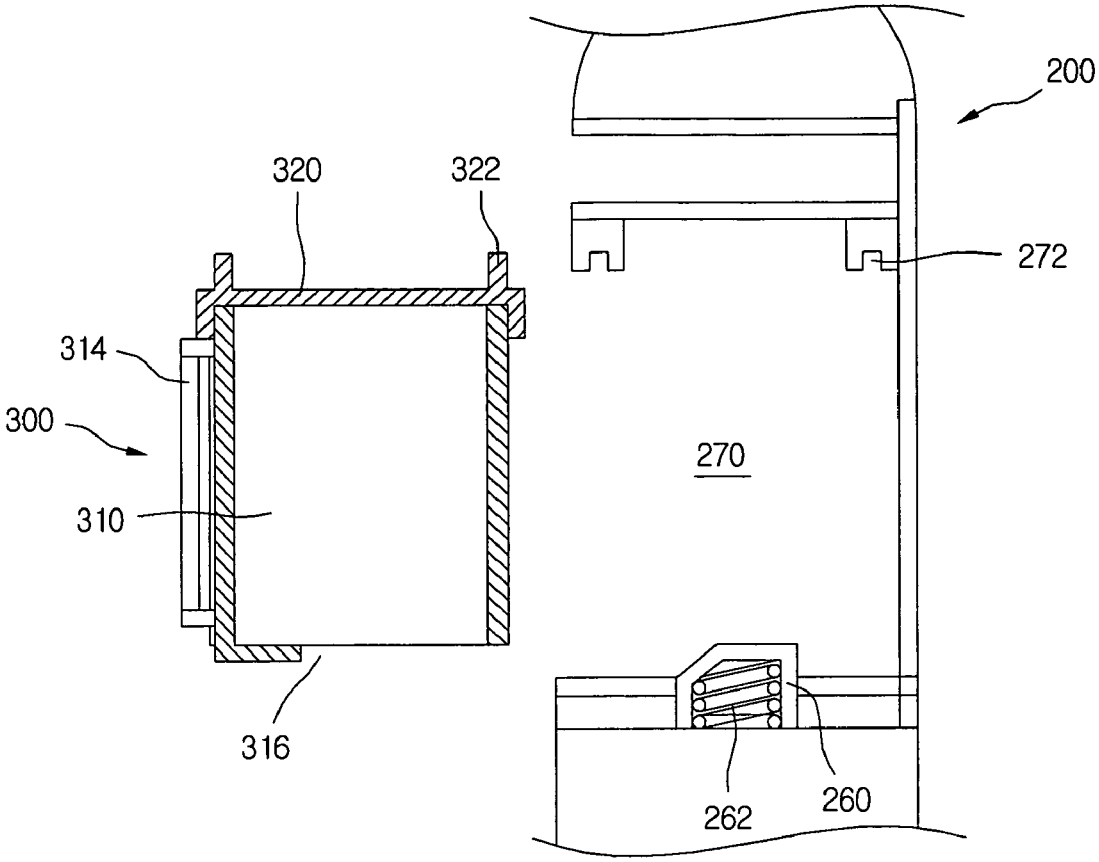
FIG. 4 is a schematic side view illustrating a state where a dust collection unit is separated from a mounting portion of a vacuum cleaner according to the present invention.
Figure 5:
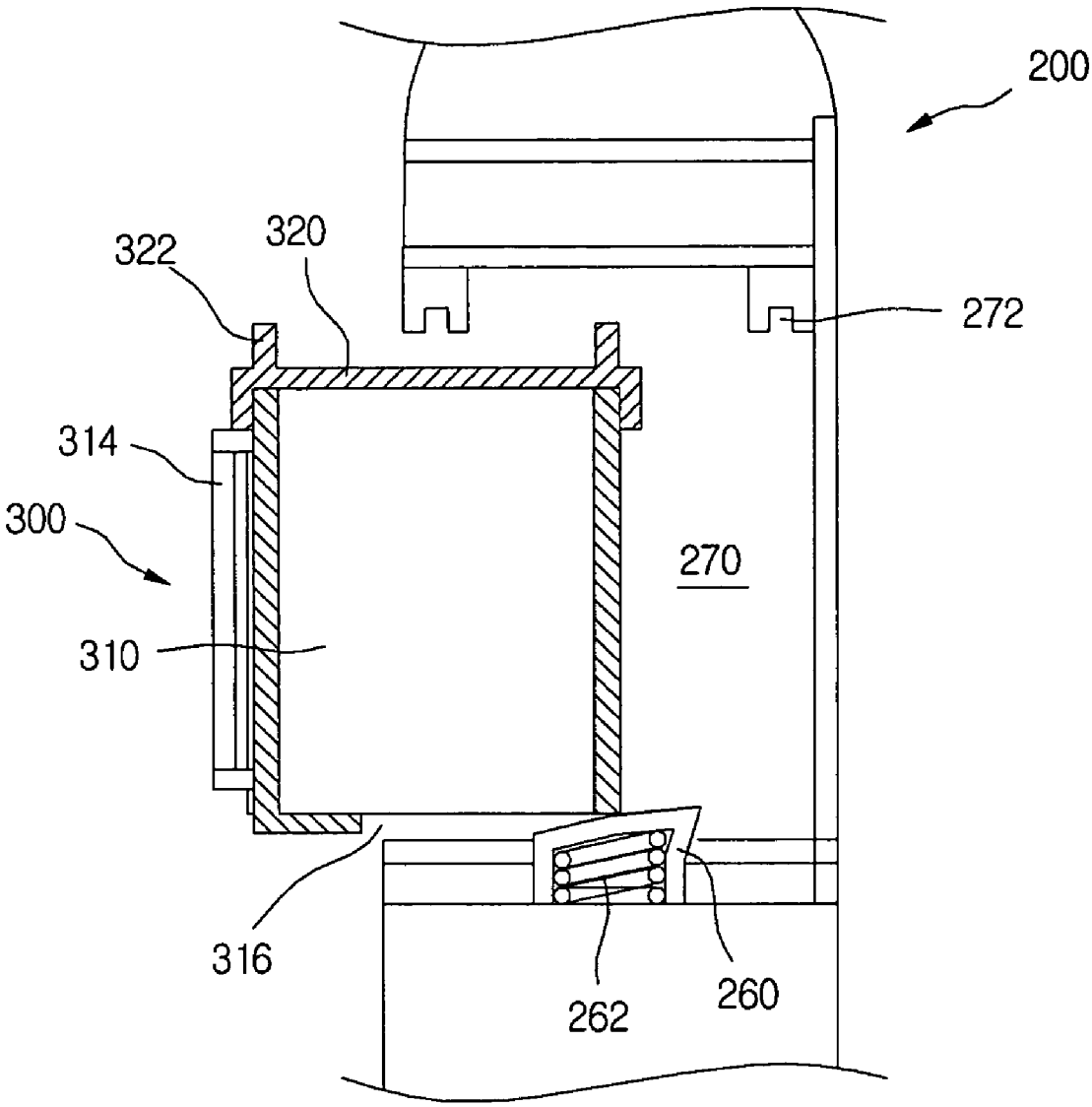
FIG. 5 is a schematic side view illustrating a state where a dust collection unit contacts a multi-joint supporting part.
Figure 6:
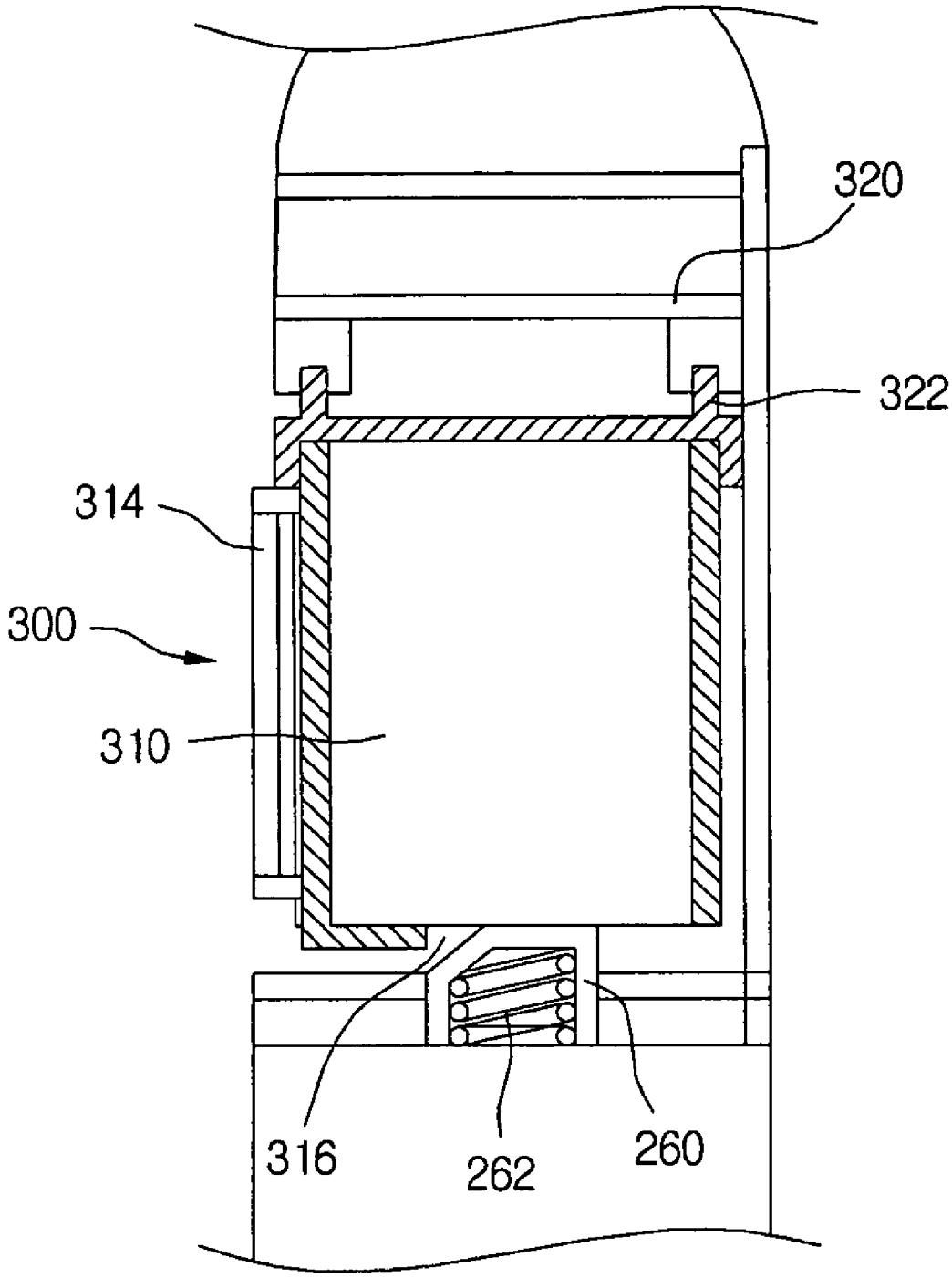
FIG. 6 is a schematic side view illustrating a state where a dust collection unit is mounted in a mounting portion of a vacuum cleaner of the present invention.

FIG. 4 is a schematic side view illustrating a state where the dust collection unit is separated from the mounting portion of the vacuum cleaner, FIG. 5 is a schematic side view illustrating a state where the dust collection unit contacts the multi-joint supporting unit, and FIG. 6 is a schematic side view illustrating a state where the dust collection unit is mounted in the mounting portion of the vacuum cleaner.

Referring to FIGS. 4 through 6, in order to mount the dust collection unit 300 in the mounting portion 270 of the main body 200, the user grasps the handle and lifts the dust collection unit 300. Then, the dust collection unit 300 is inserted into the mounting portion 270 by inserting the multi-joint supporting unit 260 into the guide 316. At this point, since the front portion of the multi-joint supporting unit 260 is inclined, the insertion of the dust collection unit 300 can be smoothly realized.

While the dust collection unit 300 is inserted in the mounting portion 270, as shown in FIG. 5, the multi-joint supporting unit 260 contacts the guide 316 to be flexibly deformed. At this point, the separation preventing rib 322 is slidably inserted into the separation preventing groove 272.

In an initial insertion of the dust collection unit 300, by depressing the dust collection unit downward, the upper end of the separation preventing rib 322 is located to be lower than the lower end of the separation preventing groove 272 so that the dust collection unit 200 can be smoothly inserted into the mounting portion 270. When the dust collection unit 300 is inserted into the mounting portion 270 by a predetermined distance, since the separating preventing rib 322 contacts the top of the mounting portion 270, the dust collection unit 200 can be smoothly inserted into the mounting portion 270 without being pressed. During the insertion of the dust collection unit 200, the lower end (the guide 316) of the dust collection unit 200 depresses the multi-joint supporting unit 260 so that the multi-joint supporting unit 260 can be flexibly deformed.

When the dust collection unit 300 is completely inserted into the mounting portion 270, as shown in FIG. 6, the locations of the separation preventing rib 322 and the separation preventing groove 272 becomes identical and the dust collection unit 300 is biased upward by the elastic member provided under the multi-joint supporting unit 260. Therefore, The separation preventing rib 322 is snugly inserted in the separation preventing groove 272, after which the multi-joint supporting unit 260 is biased upward by the elastic member 262 to return to its initial position (see FIG. 4).

When the insertion of the separation preventing rib 322 into the separation preventing groove 272 is completed and the multi-joint supporting unit 260 is returned to its initial position, the mounting of the dust collection unit is finished.

Meanwhile, in order to separate the dust collection unit 300 from the main body 200, the dust collection unit 300 is pressed downward to separate the separation preventing rib 322 from the separation preventing groove 272. At this point, the guide 316 presses the multi-joint supporting unit 26. In this state, when the dust collection unit 300 is pulled leftward (see FIG. 6), the dust collection unit 300 can be completely separated from the main body 200 as shown in FIG. 4 via a state shown in FIG. 5.

As described above, since the dust collection unit can be mounted or separated on or from the main body by simply pressing and pulling the dust collection unit, the user's convenience can be improved.

Furthermore, since a structure for mounting and separating the dust collection unit is not exposed to an external side, the outer appearance of the vacuum cleaner is not deteriorated.

Figure 7:
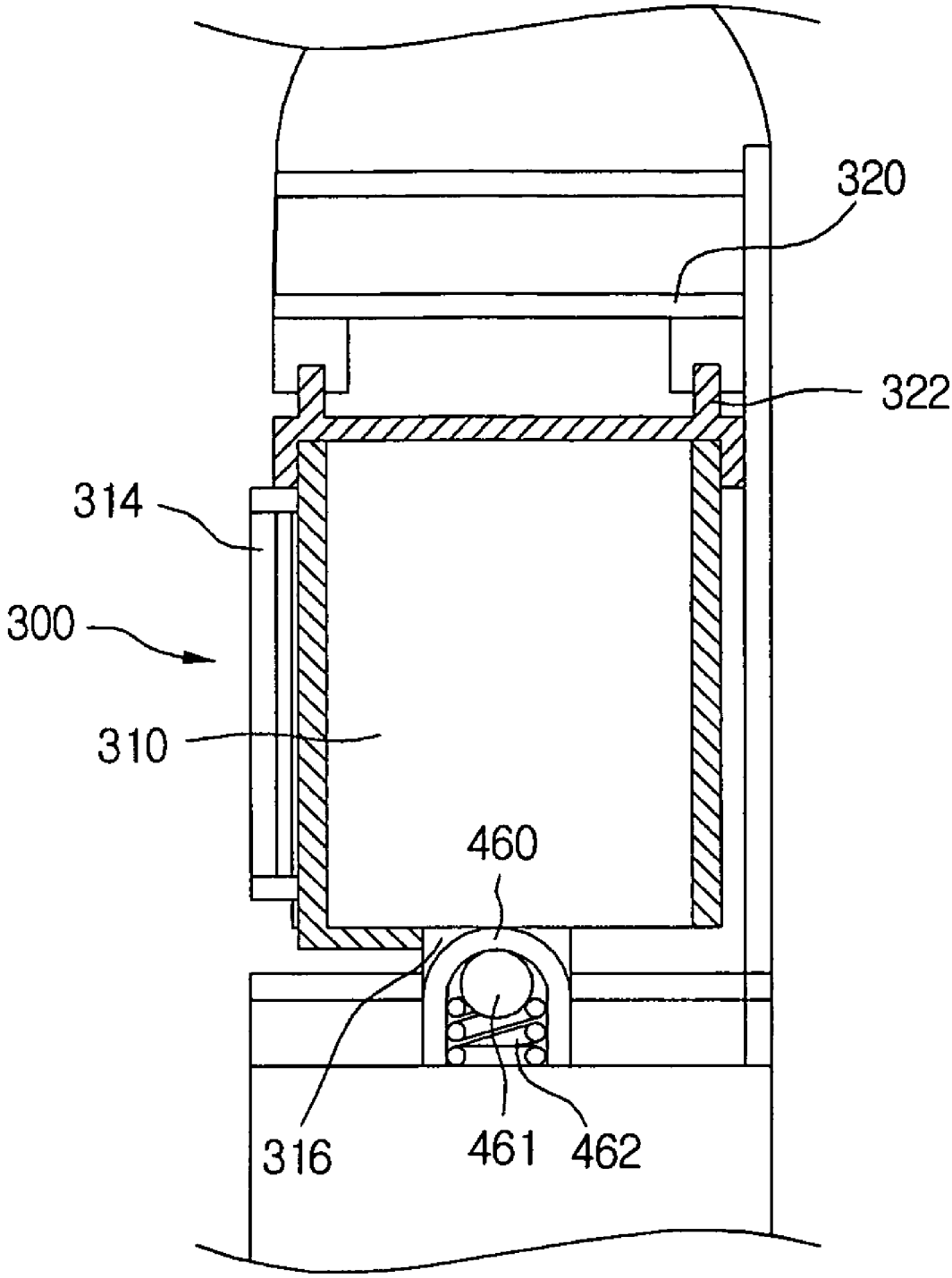
FIG. 7 is a view of another embodiment of the present invention.

FIG. 7 shows another embodiment of the present invention.

This embodiment is identical to the forgoing embodiment except for a structure of the multi-joint supporting unit.

That is, in stead of using the multi-joint supporting unit, this embodiment provides a protecting layer 460 having a plastic property and a spring 462. A ball 461 is disposed on an upper end of the spring 462. An outer surface of the protecting layer 460 is designed having a predetermined frictional coefficient such that the guide 316 contacting the outer surface of the protecting layer 460 does not slip.

In the insertion operation of the dust collection unit 300, the ball 461 is pressed by the guide 316. At this point, since the ball 461 is biased upward by the spring 462, the dust collection unit 300 is biased upward so that the separation preventing rib is inserted in the separation preventing groove.

A variety of structures for biasing the dust collection unit in addition to the structures proposed in the above embodiments may be provided. Therefore, the structure can be called an elastic pressure unit. In addition, a structure for fixing and supporting the dust collection unit using the separation preventing groove and rib may be called a hook unit.

It will be apparent to those skilled in the art that various modifications and variations can be made in the present invention. Thus, it is intended that the present invention covers the modifications and variations of this invention provided they come within the scope of the appended claims and their equivalents.

For example, although the upright type vacuum cleaner is exampled in the embodiments, the present invention is not limited to this case. That is, the present invention can be applied to the canister type vacuum cleaner.

In addition, even when the guide portion and the multi-joint supporting unit are provided under the dust collection unit and the separating preventing groove and rib are provided above the dust collection unit, the mounting and separation of the dust collection unit can be easily realized by even there is a difference in applying user's force to the dust collection unit. However, since it is convenient to use the self-gravity of the dust collection unit, the structure proposed in the embodiments will be more effective.

What is claimed is:

1. A vacuum cleaner comprising:

a main body;

a dust collection unit for filtering foreign objects contained in air introduced from the main body;

a mounting portion provided on the main body to mount the dust collection unit;

an elastic press unit provided under or above the dust collection unit to bias the dust collection unit; and a hook unit biased by the elastic press unit and provided between the dust collection unit and the mounting portion, wherein the elastic press unit includes a multi-joint supporting unit provided on a bottom of the mounting portion to apply an elastic force upward.

2. The vacuum cleaner according to claim 1, wherein the mounting portion is depressed inward of the main body.

3. The vacuum cleaner according to claim 1, wherein the elastic press unit is provided under the dust collection unit.

4. The vacuum cleaner according to claim 1, wherein the hook unit is formed in a circular frame shape.

5. The vacuum cleaner according to claim 1, wherein the dust collection unit is provided at a bottom with a depressed guide corresponding to the multi-joint supporting unit.

6. The vacuum cleaner according to claim 1, further comprising a spring disposed under the multi-joint supporting unit to bias the multi-joint supporting unit upward.

7. The vacuum cleaner according to claim 1 wherein a front surface of the multi-joint supporting unit is inclined.

8. The vacuum cleaner according to claim 1, wherein the hook unit includes a groove formed on one of the tops of the mounting portion and the dust collection unit and a rib formed on the other one of the tops.

9. The vacuum cleaner according to claim 8, wherein the groove and/or the rib is formed in a circular shape.

10. The vacuum cleaner according to claim 8, wherein the rib is formed on the top of the dust collection unit and the groove is formed on the top of the mounting portion.

11. A vacuum cleaner comprising:

a main body;

a dust collection unit for filtering foreign objects contained in air introduced from the main body;

a mounting portion provided on the main body to mount the dust collection unit;

an elastic press unit provided under the dust collection unit to bias the dust collection unit upward; and a hook unit provided between the dust collection unit and the mounting portion, wherein the elastic press unit comprises a multi-joint unit contacting a bottom of the dust collection unit and a spring biasing the multi-joint unit upward.

12. The vacuum cleaner according to claim 11, wherein the elastic press unit is projected upward from a bottom of the mounting portion.

13. The vacuum cleaner according to claim 11, further comprising a guide provided on a bottom of the dust correspond unit and corresponding to the elastic press unit.

14. The vacuum cleaner according to claim 11, further comprising a projection provided on a top of the dust collection unit; and a groove in which the projection is inserted formed on a top of the mounting portion.

15. The vacuum cleaner according to claim 14, wherein the projection and the groove are formed in a circular shape.

16. The vacuum cleaner according to claim 14, wherein a portion of the projection contacts a lower end of the groove during the mounting of the dust collection unit into the mounting portion.

17. A vacuum cleaner comprising:

a main body;

a dust collection unit for filtering foreign objects contained in air introduced from the main body;

a mounting portion provided on the main body to mount the dust collection unit;

an elastic press unit for biasing the dust collection unit toward the mounting portion, the elastic press unit including a multi-joint supporting unit provided on a bottom of the mounting portion to apply an elastic force upward; and a hook biased by the elastic press unit and provided between the dust collection unit and the mounting portion to prevent the dust collection unit from being inadvertently separated from the main body.

* * * * *